United States Patent [19]

Guinn et al.

[11] 4,081,084

[45] Mar. 28, 1978

[54] CASING HANDLING SYSTEM

[76] Inventors: David C. Guinn; Archie K. Haggard; John P. Thomas, all of P.O. Box 1126, Houston, Tex. 77001

[21] Appl. No.: 729,493

[22] Filed: Oct. 4, 1976

[51] Int. Cl.[2] ..... E21B 19/14

[52] U.S. Cl. ..... 214/1 P; 9/34; 198/486; 214/658; 294/81 R

[58] Field of Search ..... 214/620, 1 P, 1 PB, 214/DIG. 3, DIG. 4, 1 BB, 1 BD, 658, 2.5; 187/19; 294/81; 9/34, 41; 198/486

[56] References Cited

U.S. PATENT DOCUMENTS

| | | | |
|---|---|---|---|
| 2,760,662 | 8/1956 | Kughler | 214/620 X |
| 3,563,341 | 2/1971 | Bultman | 187/19 X |

FOREIGN PATENT DOCUMENTS

| | | | |
|---|---|---|---|
| 1,154,606 | 9/1963 | Germany | 294/81 R |

*Primary Examiner*—Trygve M. Blix
*Assistant Examiner*—George F. Abraham
*Attorney, Agent, or Firm*—Fulbright & Jaworski

[57] ABSTRACT

A casing handling system is disclosed which includes a pair of spaced davits provided with a gear type track upon which a traveling crane assembly is movably mounted. The crane assembly includes a trolley movably disposed on each davit, a motor driven sprocket carried by each trolley meshing with the gear track operable to move the trolleys on the davits, spaced carrying members carried by the crane assembly for load carrying engagement with and disengagement from the casing, and a means to engage and disengage them to and from the casing so that the casing can be engaged and moved from a loading station to a delivery station. Preferably, the casing carrying members are casing hooks and piston and cylinder means are carried by the crane assembly which move the hooks into and out of opposite ends of the casing.

7 Claims, 9 Drawing Figures

Fig. 7
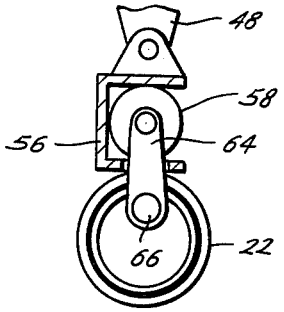
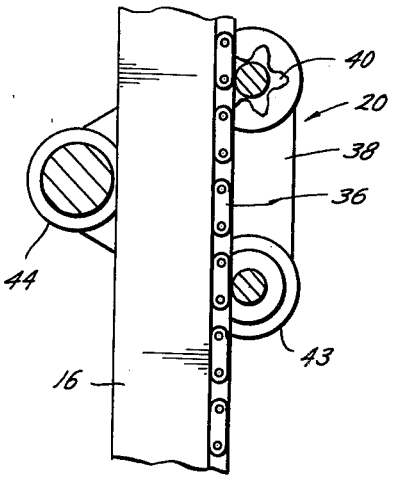
Fig. 8
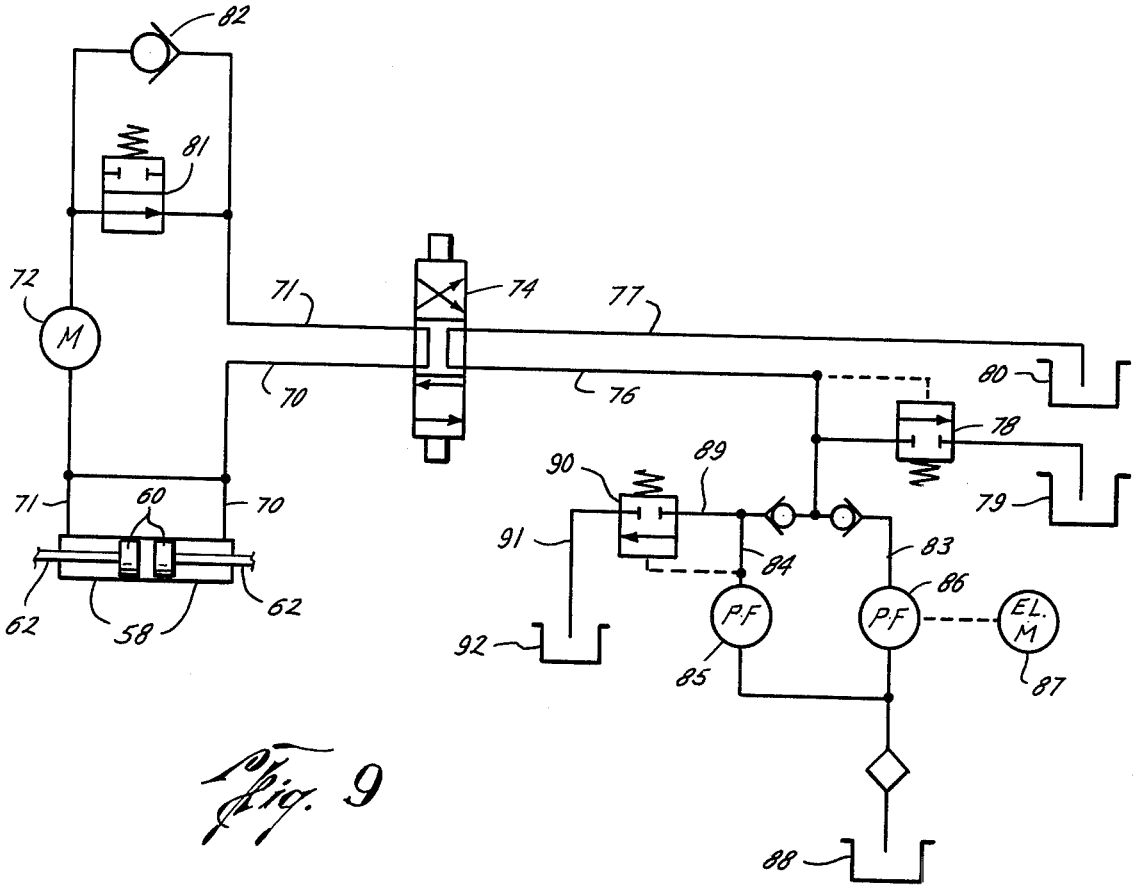
Fig. 9

CASING HANDLING SYSTEM

The casing handling system can be used both for onshore and offshore drilling, but is particularly useful for offshore operations since the davits can be releasably connected to a lower deck adjacent the casing pipe rack, with the discharge end disposed adjacent the automatic pipe racker on the upper deck so that casing from the casing rack can be moved to and from the pipe racker for normal drilling operations.

The casing handling system is operated by remore control by suitable hydraulic, pneumatic or electric motors, controls and the like or a combination of them.

Further details and features are disclosed below.

BACKGROUND OF THE INVENTION

In the rotary drilling of wells, and particularly in the rotary drilling of wells in offshore operations, there is a need for a casing handling system by which casing can be transported from the casing rack to a location where it is readily available to be run into the well bore, such as with an automatic pipe racker. Normally, in offshore operations rotary drilling is from drilling platforms or floating vessels, and, in many cases, the casing rack is located below deck although it can be located other places, such as on either side of the pipe racker, the other side of the derrick, in its own hold, or on deck, and it is necessary for the casing to be transported from the casing rack up to the upper deck adjacent the derrick floor for running into the well bore.

Patents which generally relate to casing handling systems include U.S. Pat. Nos. 2,900,091; 3,294,185; 3,420,318; 3,713,547; and 3,835,938. None of these patents, however, discloses or suggests the casing handling system of the present invention by which casing can be moved from the casing rack to a location for use in lowering into the well bore which can be accomplished easily and readily with a minimum of labor, time, swing motion and expense, and which restrains the casing from movement as a result of the dynamic motion of the vessel.

SUMMARY

The present invention is directed to such a casing handling system in which casing can be carried readily and easily from a loading station, such as a casing rack, and transported to a discharge station, such as an automatic pipe racker, with a minimum of time, effort, labor, motion and expense.

A preferred embodiment of a casing handling system according to the invention includes a pair of spaced davits extending from a casing loading station to a delivery station, each davit being provided with a gear track on its surface, and having a traveling crane assembly including a trolley movably disposed on each davit provided with a motor driven sprocket meshing with the gear track on the davit, guide wheels on each trolley disposed on opposite sides of the davit to stabilize the trolley on the davits, spaced casing carrying members carried by the crane assembly for load carrying engagement with and disengagement from the casing, and means for actuating the casing carrying members into and out of engagement with the casing so that the casing can be engaged and moved by the casing handling system from the loading station to the delivery station and there disengaged. Further features according to the invention are disclosed in the description of the preferred embodiments.

It is therefore an object of the present invention to provide a casing handling system which can transport casing from one location to another, for example, from a casing rack located below deck of an offshore drilling rig or ship to an upper deck upon which well drilling operations are taking place, readily, easily, inexpensively and with a minimum of labor.

A further object of the invention, and one of its major advantages, is to provide a casing handling system which restrains swinging motion of the casing resulting from dynamic motion of the vessel thus avoiding damage to persons and equipment and minimizing slow down on drilling operations.

A further object of the present invention is the provision of such a casing handling system which may be releasably secured in place, but which can be readily removed when desired, such as when moving from one location to another.

A further object of the present invention is the provision of such a casing handling system which includes a pair of spaced davits extending from a casing loading station to a casing delivery station, upon which davits are movably mounted a crane assembly including a trolley movably disposed on each davit having a motor driven sprocket meshing with a gear track disposed on the davits, a pair of spaced casing carrying members arranged for load carrying engagement with and disengagement from the casing, and means for actuating them into engagement and out of engagement so that casing can be engaged at the loading station, moved to the delivery station, and there disengaged.

A further object of this invention is the provision of such a casing handling system which can be operated remotely with a minimum of time, labor and expense.

A still further object of the invention is the provision of such a casing handling system which may readily be stored below deck, when desired.

Other and further objects, features and advantages of the present invention will be apparent from the Abstract of the Disclosure, the Background of the Invention, this Summary, the Drawings, the Description of the Preferred Embodiments and the Claims.

BRIEF DESCRIPTION OF THE DRAWINGS

FIG. 7 is a view taken along the line 6—6 of FIG. 4.

FIG. 8 is a view taken along the line 8—8 of FIG. 4.

FIG. 9 illustrates a suitable hydraulic system for actuating by remote control the casing handling system.

DESCRIPTION OF PREFERRED EMBODIMENTS

Figure 1:
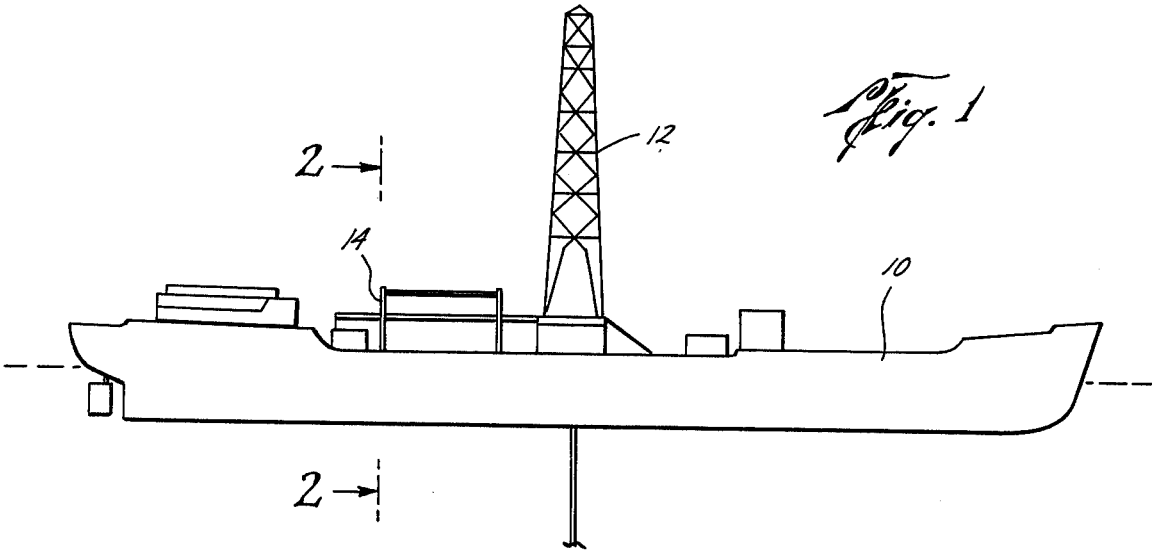
FIG. 1 is a side view illustrating a drilling ship utilizing a casing handling system according to the invention.

Referring now to the drawings, and particularly to FIG. 1, the casing handling system is illustrated for moving casing below deck to the upper operating deck of a floating vessel 10 having the derrick 12 and the automatic pipe racker 14, as well as other equipment, utilized in the rotary drilling of wells from the floating ship. The casing handling system of the present invention, however, is well adapted and suited for moving casing from a loading station, such as a casing rack, to a delivery station in all rotary drilling of wells, both onshore and offshore, from fixed or floating platforms. The casing handling system, however, is particularly advantageous when used for drilling in offshore drilling operations, such as from the floating vessel 10, and, accordingly, the description for the purpose of disclosure is described in connection with this particular use.

Figure 2:
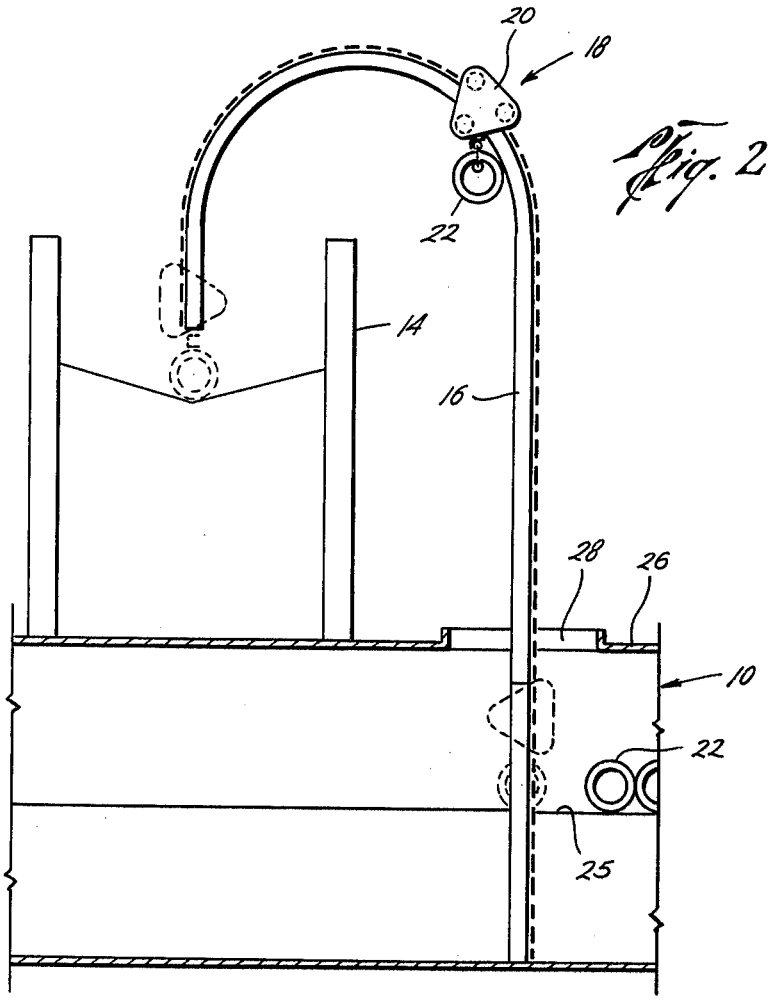
FIG. 2 is a view taken along the line 2—2 of FIG. 1 illustrating an embodiment of the casing handling system.
Figure 3:
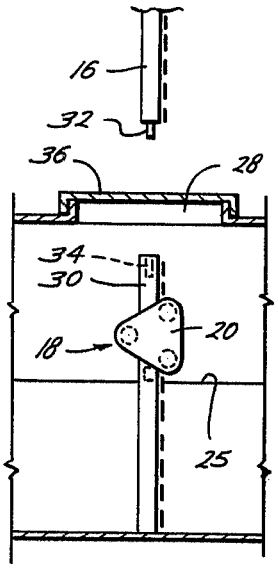
FIG. 3 is a fragmentary, side view illustrating means for releasably securing the davits to a support member.

Referring now to FIGS. 2 and 3, the casing handling system includes a pair of transversely spaced davits 16 upon which is mounted a traveling crane assemby 18, including a trolley 20 movably disposed on each davit 16, having a pair of spaced carrying members which are arranged to engage and disengage the casing 22 normally stored on the casing rack shown here on the lower deck 25. The davits 16 extend from the lower deck or casing rack 25 to the upper deck 26 through the opening 28 and is operable to transport the casing 22 from the lower deck or casing rack 25 to the automatic pipe racker 14 on the upper or operational deck 26 which is adjacent the derrick 12 for use in normal drilling operations.

No detailed description is given of the pipe racker 14 as these are readily available on the commercial market and do not form any part of the present invention, the automatic pipe racker 14 being the delivery station for purposes of illustration. A pipe racker, of course, is not essential to the casing handling system as other racking can be used, such as manual and other means used on rigs.

The davits 16 may take any desired shape and may extend any desired distance and are here shown as being rectangular in cross-section (FIG. 5) and extending upwardly a substantial distance from the lower deck 25 and then curving downwardly to a point where the casing 22 can be deposited for discharge into the casing or pipe racker 14.

The davit 16 is releasably secured to a support member by means of the stub 32 which is inserted into the bushing 34 of the support member 30, which here is an extension of the davit 16 so that the movable crane assembly 18 can move downwardly on it to be in a stored position or to be adjacent the loading station, here shown as the casing rack 25. Any desired means may be utilized to releasably secure the davit 16 to a support member, at either the loading or discharge stations.

Thus, when traveling to location, in high seas or heavy weather, the traveling crane assembly 18 can be lowered to the stowed position illustrated in FIG. 3, the davits 16 readily and easily removed by a crane, not shown, and stowed as desired, for example, on the lower deck 25, and the hatch 36 can be placed over the opening 28. When it is desired to use the casing handling system, the hatch 36 can be opened, the davits 16 then attached to the support member 30 and the casing handling system is ready for use.

Referring now to FIGS. 4–8, disposed on each of the transversely spaced davits 16 is a gear track 36, here shown as a gear chain welded or otherwise secured to the davit 16, and each trolley 20, includes the spaced body members 38, to which is secured the drive sprocket 40 which meshes with the gear track 36 upon which it is immovably mounted for driving the trolleys 20 on the davits.

The traveling crane assembly 18 includes a cross member 42, which secures the trolleys 20 together and causes them to move as a unit, serves as a reinforcing member, and from which is suspended the spaced carrying members means for engaging and disengaging the casing 22, generally indicated by the reference numeral 46, which is carried by the swivel eyes 48 depending from the cross member 42 connected to the bosses 49.

The traveling crane assembly 18 carries a motor M which drives the gears, not shown, in the gear box 50, which in turn drives the drive shaft 52, which in turn drives the drive shafts 54 upon which the gear sprocket 40 are secured so that the traveling crane 18 can be moved along the davits 16. As illustrated, the swivel eyes 55 are provided from the cross member 42 to the drive shaft 52 to provide stability to the latter.

Figures 4, 5, 6:
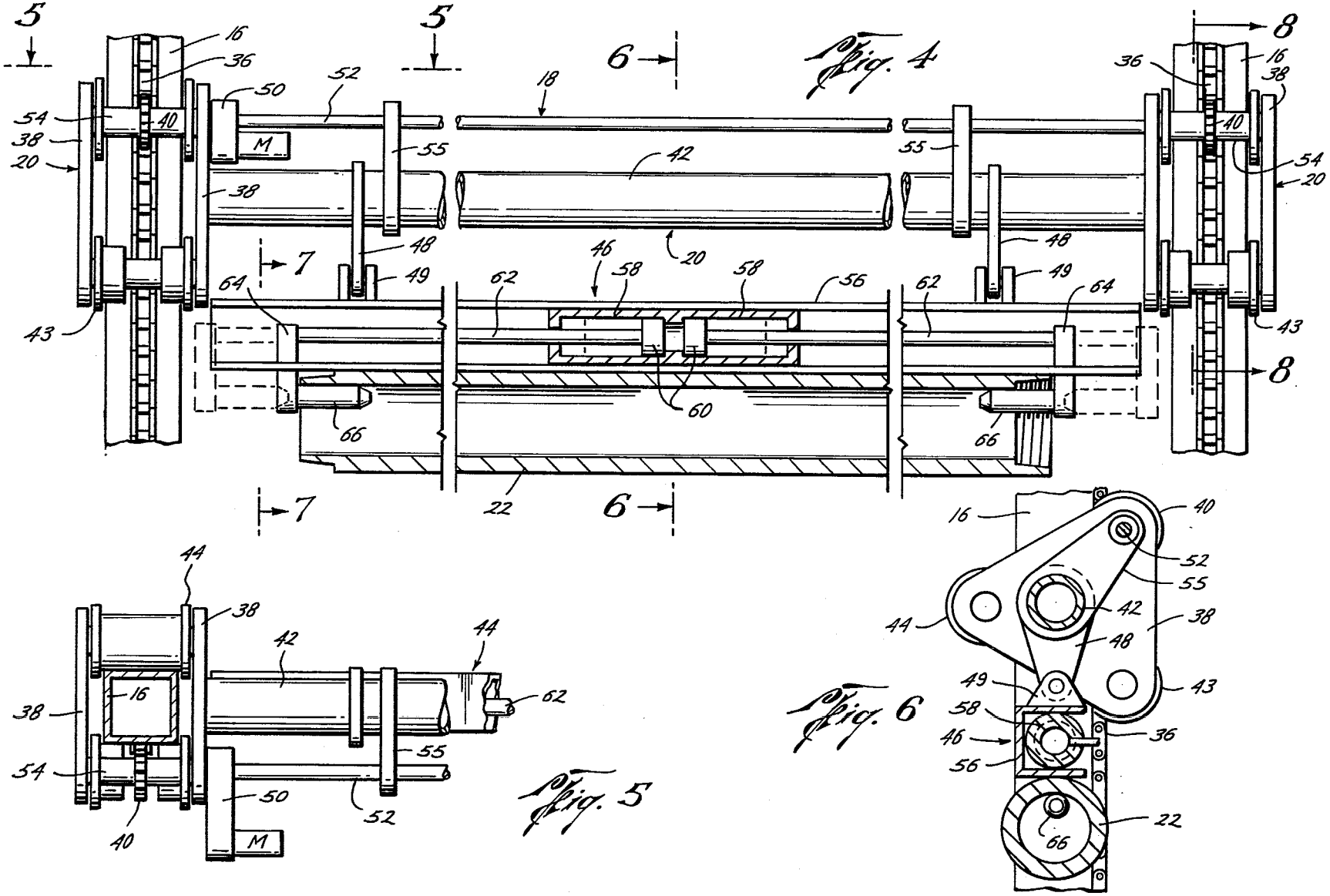
FIG. 4 is a front view, with parts broken away, illustrating the casing handling system.
FIG. 5 is a view taken along the line 5—5 of FIG. 4.
FIG. 6 is a view taken along the line 6–5 of FIG. 4.

As best seen in FIG. 5, a structural support for carrying member 56 for the cylinders 58 is provided which is carried by the cross member 42 by means of the swivel eyes 48 connected to the bosses 49 attached to the support member 56 for the cylinders 58, as previously mentioned.

The casing engaging and disengaging means 46 include the cylinders 58 into which are disposed the pistons 60 secured to the piston rods 62, which in turn are secured to the casing hook members 64 and 66, which hook members 66 can be moved into and out of opposite ends of the casing 22, as illustrated in the dotted lines in FIG. 4, by actuation of the piston and cylinder means 58 and 60.

As best seen in FIGS. 6 and 8, each of the trolleys 20 includes the idler wheels 43 and 44 secured to the spaced body member 38, which idler wheels are disposed on opposite sides of the davits 16 to securely hold the trolleys 20 on its respective davits, the davits 16 serving as a track for them.

Referring now to FIG. 9, a suitable hydraulic system is illustrated for actuating the casing handling system.

The hydraulic system includes the hydraulic lines 70 and 71 which are connected to the cylinders 58 for providing hydraulic pressure therein to move the pistons 60 back and forth, which in turn moves the rods 62 so that the casing engaging means can be actuated into and out of engagement with the casing to be handled.

The lines 70 and 71 are also connected to the motor 72 for actuating the sprocket 40 for moving the traveling crane and trolley on the davits 16, as previously described. A counter-balancing valve 81, check valve 82 and a four-way vlave 74 are provided for controlling flow of hydraulic fluid to the cylinder 58 and motor 72.

The hydraulic line 70 and 71 are connected through the 4-way valve 74 to the lines 77 and 76, the hydraulic line 77 extending to and unloading reservoir 80, and the line 76 being connected to the main relief valve 78 and an unloading reservoir 79. The line 76 is also connected through check valves to the lines 83 and 84 which are in turn connected to the pumps 85 and 86, driven by the motor 87 for pumping hydraulic fluid into the system from the hydraulic fluid reservoir 88. A counterbalanced unloading valve 90 is provided for unloading hydraulic liquid into the reservoir 92.

While the hydraulic reservoirs are illustrated separately at 79, 80, 88 and 92 for the purpose of and ease of disclosure, in actual practice these will all constitute a single reservoir. Also, suitable controls and the like, not shown, are provided so that the system can be operated remotely with a minimum of manual labor.

Thus, actuation of the four-way valve 74 directs hydraulic fluid to the pistons 58 for actuating the casing grappling members and actuating the motor for driving the trolleys on the davits.

Since any desired hydraulic remote control system can be utilized, many of which are available on the market, no further description thereof is deemed necessary or given.

While a hydraulic system has been shown and described as an example of means for remotely actuating the casing handling system, any desired actuating means can be used, such as hydraulic, pneumatic, electric pr a combination of them.

When the ship 10 is going from one location to another, or in high seas, or heavy weather, the davits 16 are removed from the davit continuations or supports 30 and the davits 16 are stored either below deck or as desired, and the hatch 36 placed over the opening 28. When it is desired to use the casing handling system the hatch 36 is opened, and the davits 16 are secured in the davit continuations or supports 30 below deck. The casing handling system is then ready for operation and use.

In operation, the traveling crane 20 is lowered to adjacent the lower deck and casing rack 25 which has the stored casing 22. The casing engaging means 46 is then actuated so that the hook like members 66 are disposed within the casing 22. The motor 72 is then actuated so that the traveling crane 18 and casing 22 moves upwardly on the davits and down and over to the position illustrated in dotted lines FIG. 2 in the automatic pipe racker 14, where the casing 22 is disengaged. The traveling crane is then moved back to the position below deck where the procedure is repeated.

If for any reason it is desired to move casing from the pipe racker 14 to the lower deck or casing rack 25, the procedure is simply reversed with the casing engaging and carrying means 46 engaging the casing 22 in the pipe racker 14 and transporting it below deck to the casing rack 25 where it is disengaged.

As previously mentioned, in the event of high seas, heavy weather or moving from one location to another, the davits 16 may be removed and stored where desired, for example, below deck, and the hatch 36 placed on the deck opening 28.

Thus, the casing handling system is well suited and adapted to attain the objects and ends and has the advantages and features mentioned as well as others inherent therein.

While preferred embodiments of the invention have been given for the purpose of disclosure, changes may be made therein which are within the spirit of the invention as defined by the scope of the appended claims.

What is claimed is:

1. A casing handling system for moving casing from a casing rack to a casing racker located a horizontal and vertical distance from the casing rack comprising, a pair of immovably mounted davits having a loading station adjacent the casing rack and extending to and having a delivery station adjacent the casing racker, the davits being transversely spaced from one another a distance greater than the length of the casing, a gear track on a surface of each of the spaced davits, a crane assembly, including, a trolley movably disposed on each davit, a motor-driven sprocket carried by each trolley meshing with the gear track on the davit on which it is movably disposed operable to move the trolley on the davit, a motor carried by the crane assembly operable to drive the sprockets, a cross member connected and extending transversely between the trolleys securing the trolleys together so that they move as a unit on the davits, a pair of transversely spaced carrying members disposed below the cross member having support members arranged to move transversely and freely into and out of opposite ends of the casing for load-carrying support of and removal from the casing, means connected to the spaced carrying members operable to move the members into and out of the opposite ends of the casing, and swivel means connecting the last mentioned means to and below the cross member effective to permit swiveling of the carrying means and thus of the casing when carried to a position below the cross member, whereby the casing is supported below the carrying members and between the davits when being moved by the casing handling system from the loading station to the delivery station.

2. The casing handling system of claim 1, where, the carrying and support members comprise hooks and transversely and inwardly extending projections.

3. The casing handling system of claim 1, where, each trolley includes guide wheels disposed on opposite sides of each davit on which it is movably disposed, the guide wheels and the sprocket maintaining each trolley on its davit.

4. The casing handling system of claim 1, where, each trolley includes guide wheels disposed on opposite sides of the davit on which it is movably disposed, the guide wheels and the sprocket maintaining each trolley on its davit, and the support members arranged to move transversely into and out of the opposite ends of the casing comprise transversely and inwardly extending projections.

5. The casing handling system of claim 1, where, the pair of davits are immovably mounted by means releasably connecting them to a support member adjacent at least one of the casing loading and delivery stations.

6. The casing handling system of claim 1, where, the gear track is a chain gear.

7. A casing handling system for moving casing from a casing rack to a casing racker located a horizontal and vertical distance from the casing rack comprising, a pair of immovably mounted davits having a loading station adjacent the casing rack and extending to and having a delivery station adjacent the casing racker, the davits being transversely spaced from one another a distance greater than the casing, a chain gear track on the surface of each of the spaced davits, a crane assembly including, a trolley movably disposed on each davit, a motor-driven sprocket carried by each trolley meshing with the gear track on the davit on which is it movably disposed operable to move the trolley on the davit, guide wheels on each trolley disposed on opposite sides of the davit on which the trolley is movably disposed, the guide wheels and the sprocket maintaining each trolley on its davit, drive the sprockets, a cross member connected to and extending transversely between the trolleys securing them together so that the trolleys move as a unit, a pair of spaced hooks having transversely and inwardly extending projections adapted to be moved freely into and out of opposite ends of the casing for supporting and releasing the casing, piston and cylinder means disposed above and connected to the spaced hooks operable to move the projections into and out of the opposite ends of the casing, swivel means connecting the piston and cylinder means to and below the cross member thereby permitting swiveling between the davits of the piston and cylinder means, the pair of spaced hooks, and the casing to a position below the cross member when carried by the spaced hooks, and means operable to actuate the piston and cylinder means and the motor, whereby the casing is supported below the spaced hooks and between the davits when being moved by the casing handling system from the loading station to the delivery station.

the pair of davits are immovably mounted by means releasably connected to a support adjacent at least one of the casing loading and delivery stations.

* * * * *

UNITED STATES PATENT OFFICE

CERTIFICATE OF CORRECTION

Patent No. 4,081,084 Dated March 28, 1978

Inventor(s) David C. Guinn; Archie K. Haggard; John P. Thomas

It is certified that error appears in the above-identified patent and that said Letters Patent are hereby corrected as shown below:

Column 2, line 65, after the word "upper", add the word "or"

Column 4, line 50, change the word "vlave" to "valve"

Column 6, line 7, after the word "connected", add the word "to"

Column 7, line 1, change "is it" to " it is"

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*